US010947031B2

(12) United States Patent
Polloni et al.

(10) Patent No.: US 10,947,031 B2
(45) Date of Patent: Mar. 16, 2021

(54) RIGID PACKAGE FOR TOBACCO ARTICLES WITH A HINGED LID AND WITH A WRAP PROVIDED WITH A RE-STICK SEALING FLAP

(71) Applicant: G.D SOCIETA' PER AZIONI, Bologna (IT)

(72) Inventors: Roberto Polloni, Modigliana (IT); Alver Tacchi, Bologna (IT); Luca Federici, Bologna (IT); Luca Paradiso, Monteveglio (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 380 days.

(21) Appl. No.: 15/769,815

(22) PCT Filed: Oct. 28, 2016

(86) PCT No.: PCT/IB2016/056532

§ 371 (c)(1),
(2) Date: Apr. 20, 2018

(87) PCT Pub. No.: WO2017/072731

PCT Pub. Date: May 4, 2017

(65) Prior Publication Data

US 2020/0247605 A1 Aug. 6, 2020

(30) Foreign Application Priority Data

Oct. 28, 2015 (IT) ..... 102015000066280

(51) Int. Cl.
*B65D 85/10* (2006.01)

(52) U.S. Cl.
CPC ... *B65D 85/10568* (2020.05); *B65D 85/1027* (2013.01); *B65D 85/1081* (2013.01)

(58) Field of Classification Search
CPC ..... B65D 85/10568; B65D 85/1027; B65D 85/1081
(Continued)

(56) References Cited

U.S. PATENT DOCUMENTS 2,897,958 A * 8/1959 Tarleton ..... A24F 15/12 206/250
3,102,675 A * 9/1963 Schrom ..... B65D 85/1054 206/251
(Continued)

FOREIGN PATENT DOCUMENTS

CN 1520375 A 8/2004
CN 102712384 A 10/2012
(Continued)

OTHER PUBLICATIONS

European Patent No. 3368440, Opposition writ filed by Focke & Co. (Gmbh & Co. KG) against Patent Owner G.D Societa per Azioni, filed Jun. 9, 2020.
(Continued)

*Primary Examiner* — Jacob K Ackun
(74) *Attorney, Agent, or Firm* — Marshall, Gerstein & Borun LLP

(57) ABSTRACT

A rigid package for tobacco articles with a hinged lid and having: at least one group of tobacco articles; at least one wrap, which encloses the group of tobacco articles and has a tobacco article extraction opening closed by a re-stick sealing flap; an outer container, which houses the wrap; a lid having a rear wall, which is hinged to the rear wall of the outer container so as to allow the lid to rotate relative to the outer container; an inner container, which houses the wrap and is arranged inside the outer container in a sliding manner; and a lifting mechanism, which moves the inner container relative to the outer container, using the rotation movement of the lid, between a lowered position, in which
(Continued)

the inner container is completely inserted into the outer container, and an extracted position, in which the inner container is partially extracted from the outer container.

10 Claims, 12 Drawing Sheets

(58) Field of Classification Search
USPC ..... 206/248, 249, 250, 254, 255, 264, 265
See application file for complete search history.

(56) References Cited

U.S. PATENT DOCUMENTS

| | | | | |
|---|---|---|---|---|
| 3,446,338 | A * | 5/1969 | Bozyk | B65D 5/6602 206/250 |
| 3,589,505 | A * | 6/1971 | Burniski | A24F 15/12 206/250 |
| 4,300,676 | A | 11/1981 | Focke et al. | |
| 4,303,154 | A * | 12/1981 | Hicks | B65D 85/109 206/236 |
| 6,164,444 | A | 12/2000 | Bray et al. | |
| 6,726,006 | B1 | 4/2004 | Funderburk et al. | |
| 8,464,867 | B2 * | 6/2013 | Holloway | B65D 85/1009 206/250 |
| 9,499,331 | B2 | 11/2016 | Seyfferth De Oliveira | |
| 9,533,821 | B2 | 1/2017 | Buse | |
| 10,597,222 | B2 * | 3/2020 | Slavomir | B65D 85/1045 |
| 2006/0070896 | A1 * | 4/2006 | Focke | B65D 85/1036 206/248 |

FOREIGN PATENT DOCUMENTS

| | | | |
|---|---|---|---|
| CN | 104114465 | A | 10/2014 |
| DE | 2437765 | A1 | 3/1975 |
| DE | 2809548 | A1 | 9/1978 |
| DE | 102011119344 | A1 | 4/2013 |
| EP | 2325093 | A1 | 5/2011 |
| EP | 2167401 | B1 | 7/2011 |
| EP | 2366637 | A1 | 9/2011 |
| EP | 2754622 | A1 | 7/2014 |
| FR | 2087240 | A5 | 12/1971 |
| TW | 201536646 | A | 10/2015 |
| WO | WO-2008142540 | A1 | 11/2008 |
| WO | WO-2009/004421 | A2 | 1/2009 |
| WO | WO-2011/051076 | A1 | 5/2011 |
| WO | WO-2012/147073 | A1 | 11/2012 |
| WO | WO-2013/131616 | A1 | 9/2013 |
| WO | WO-2014/082717 | A1 | 6/2014 |
| WO | WO-2014/096207 | A1 | 6/2014 |
| WO | WO-2014/188358 | A1 | 11/2014 |
| WO | WO-2015/011621 | A1 | 1/2015 |
| WO | WO-2015/052326 | A1 | 4/2015 |
| WO | WO-2015/144584 | A1 | 10/2015 |
| WO | WO-2016/063247 | A1 | 4/2016 |
| WO | WO-2016/166692 | A1 | 10/2016 |

OTHER PUBLICATIONS

International Application No. PCT/IB2016/056532, International Search Report and Written Opinion, dated Feb. 16, 2017.

* cited by examiner

RIGID PACKAGE FOR TOBACCO ARTICLES WITH A HINGED LID AND WITH A WRAP PROVIDED WITH A RE-STICK SEALING FLAP

CROSS-REFERENCE TO RELATED APPLICATIONS

This is U.S. national phase of International Application No. PCT/IB2016/056532, filed Oct. 28, 2016, which claims the benefit of Italian Patent Application No. 102015000066280, filed Oct. 28, 2015.

TECHNICAL FIELD

The invention relates to a rigid package for tobacco articles with a hinged lid and with a wrap provided with a re-stick sealing flap.

The invention finds advantageous application in a cigarette package, to which explicit reference will be made in the description below without because of this loosing in generality.

PRIOR ART

A cigarette package usually comprises an inner wrap, which consists of a group of cigarettes wound in a wrapper, and an outer wrap, which encloses the inner wrap and can consist of a wrapper folded around the inner wrap and with the shape of a cup (soft cigarette package), or it can consist of a rigid box with a hinged lid, which is formed by folding a blank around the inner wrap (rigid cigarette package). In a traditional cigarette package, the group of cigarettes is internally wound in an rectangular inner wrapper made of metallized paper and without glue, and it is also externally wound in a rectangular outer wrapper, which is stabilized by means of gluing.

Tobacco is very sensitive to the effects of the external environment, as, when it comes into contact with the atmosphere, it has a tendency to change its organoleptic features both due to humidity changes (tobacco can become too dry or it can absorb too much humidity) and due to the evaporation of volatile substances with which it was impregnated (especially in case of cigarettes with special flavours). In order to preserve the integrity of the tobacco contained in the cigarettes, cigarette packages are cellophaned, namely they are covered with a heat-sealed outer overwrap made of an impermeable plastic material. However, the heat-sealed outer overwrap may not be sufficient to completely preserve the organoleptic features of the tobacco contained in a cigarette package, especially when the cigarette package is used after a given amount time has elapsed since its production. Furthermore, when the package is opened for the first time, the outer overwrap is (at least partially) eliminated and, therefore, the tobacco of the cigarettes contained in the package comes into contact with the external environment; if the cigarettes contained in the package are not used a short time after the first opening of the package, the organoleptic features of the cigarettes left in the package can be jeopardized.

In order to try and avoid the drawback described above, patent U.S. Pat. No. 4,300,676A1 discloses a rigid cigarette package, wherein the inner wrap is sealed (namely, it is impermeable) and consist of wrapper, which is made of an impermeable and heat-sealable material and has a cigarette extraction opening, which is closed by a re-stick sealing flap; in other words, the sealing flap is provided with a reusable adhesive, which does not dry up and allows the sealing flap to be stuck many times in a closing position, in which it closes the cigarette extraction opening. In order to allow the user to grab the sealing flap so as to lift (i.e. open) the sealing flap, there is provided a graspable holding tab, which is arranged in the area of the lower edge of the sealing flap and is not provided with the reusable adhesive.

However, the holding tab generally is small-sized, so as not to excessively sacrifice the cigarette extraction opening (as a matter of fact, the larger the holding tab, the smaller the cigarette extraction opening); as a consequence, in known cigarette packages, the holding tab is fairly small and, therefore, it is not always easy to be grasped by the smoker.

In order to make it easier for the holding tab to be grasped, solutions have been suggested, in which the holding tab is folded by 180° (namely, in a "U" shape) against the remaining part of the sealing flap and is maintained folded in the position thanks to the presence of the front wall of the lid; by so doing, when the lid is opened, the holding tab is detached from the remaining part of the sealing flap due to an elastic return and, therefore, it can be more easily grasped. However, the smoker, when closing the lid, must previously press (squeeze) the holding tab against the remaining part of the sealing flap in order to prevent the sealing flap from assuming undesired position and, therefore, being wrongly folded by the front wall of the lid; as a consequence, closing the lid can sometimes become a relative complicated operation.

Patent application WO2015144584A1 describes a rigid cigarette package comprising; a group of cigarettes; a wrap, which encloses the group of cigarettes; an outer container; a lid, which is hinged to the outer container; an inner container, which houses the wrap and is arranged inside the outer container in a sliding manner; and a lifting mechanism, which connects the inner container to the lid so as to move the inner container relative to the outer container by using the rotation movement of the lid.

Patent application WO2015052326A1 describes a rigid cigarette package comprising: a group of cigarettes; a wrap, which encloses the group of cigarettes; an outer container, which houses the wrap; and a lid, which is hinged to the outer container. The wrap has a tobacco article extraction opening, which is closed by a re-stick sealing flap and is provided with a graspable holding tab, which is arranged in the lower part of the sealing flap and is "U"-folded against the remaining part of the sealing flap.

DESCRIPTION OF THE INVENTION

The object of the invention is to provide a rigid package with a hinged lid and with a wrap provided with a re-stick sealing flap, said rigid package does not suffer from the drawbacks described above (in particular, it allows the holding tab to be easily grasped without reducing the extraction opening and with no complications in the opening and closing of the lid) and, at the same time, is simple and cheap to be produced.

According to the invention, there is provided a rigid package with a hinged lid and with a wrap provided with a re-stick sealing flap according to the appended claims.

BRIEF DESCRIPTION OF THE DRAWINGS

The invention will now be described with reference to the accompanying drawings, which show a non-limiting embodiment thereof, wherein.

PREFERRED EMBODIMENTS OF THE INVENTION

Figure 2:
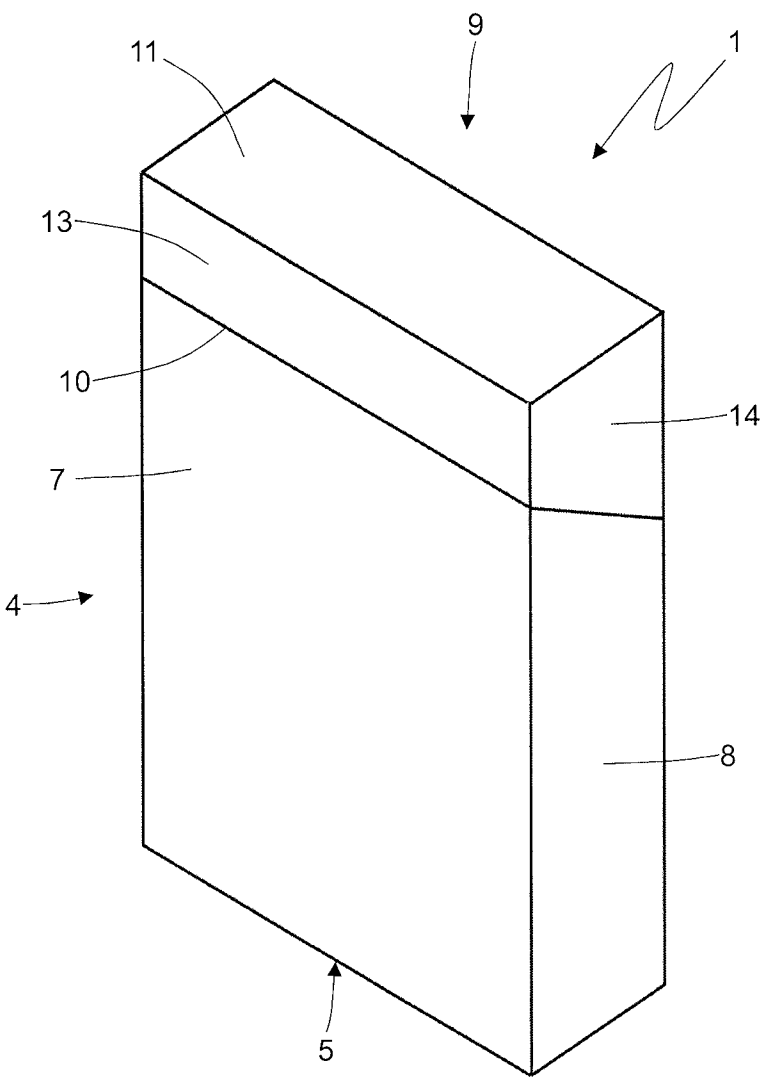
FIG. 2 is a perspective rear view of the cigarette package of FIG. 1 in a closed configuration.
Figure 1:
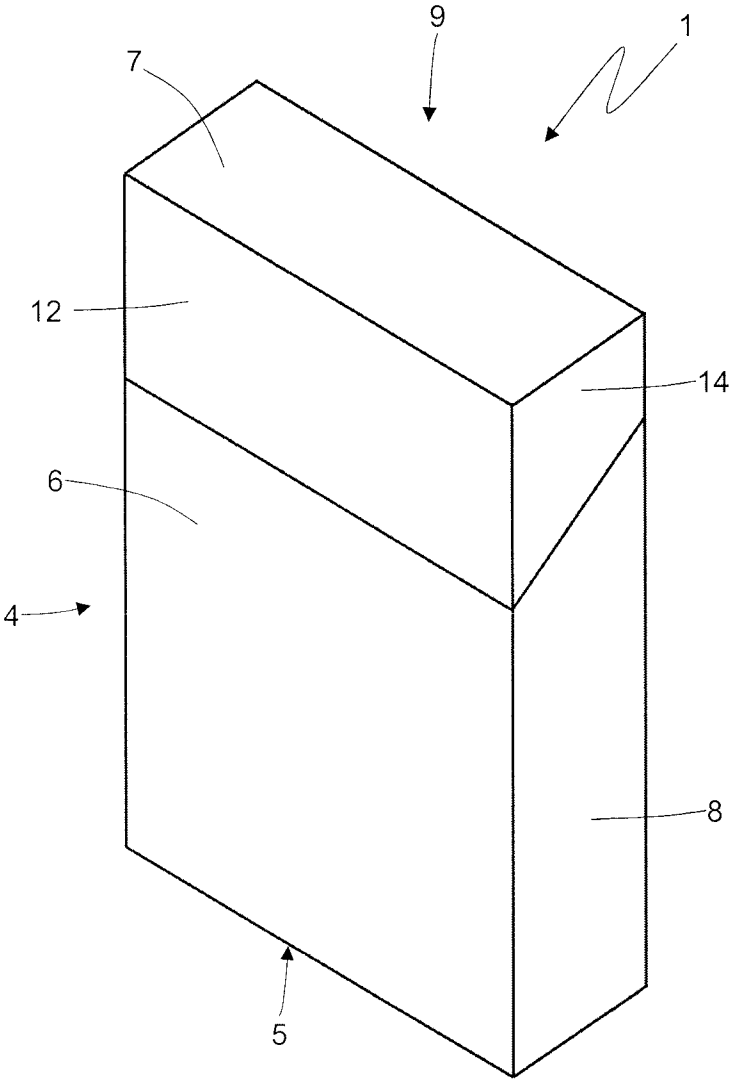
FIG. 1 is a perspective front view of a rigid cigarette package in a closed configuration, manufactured according to the invention.
Figure 3:
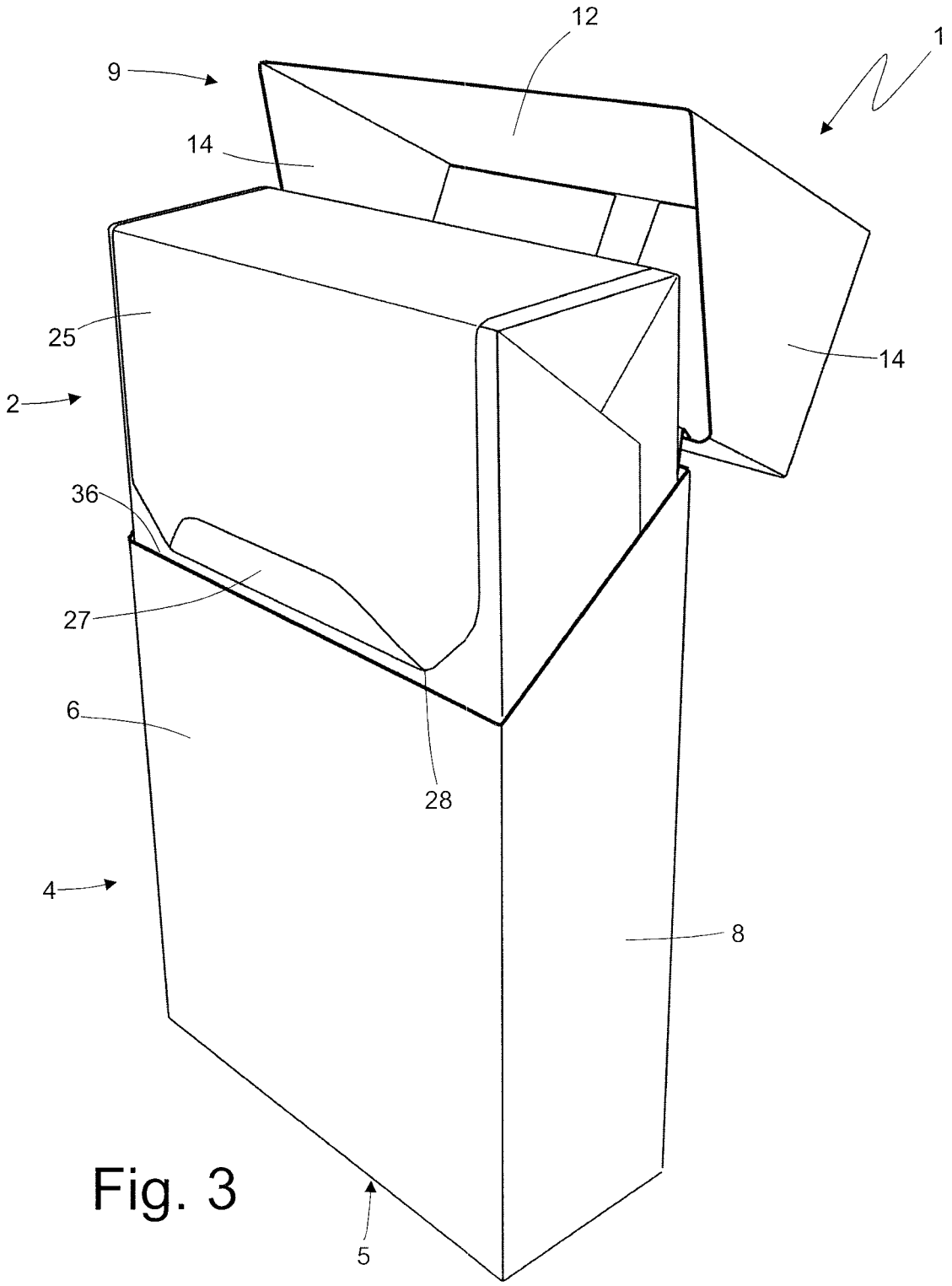
FIG. 3 is a perspective front view of the cigarette package of FIG. 1 in an open configuration.

In FIGS. 1, 2 and 3, number 1 indicates, as a whole, a rigid cigarette package with a hinged lid.

The cigarette package 1 comprises a sealed wrap 2 (schematically visible in FIGS. 3, 6 and 8), a rigid inner container 3 (not visible in FIGS. 1, 2 and 3 and, on the other hand, completely visible in FIG. 4), which directly houses the wrap 2, and a rigid outer container 4, which houses the inner container 3 in a sliding manner so as to allow the inner container 3 to slide relative to the outer container 4 and to move with a linear translation movement between a lowered position (shown in FIGS. 1, 2, 5 and 7), in which the inner container 3 is completely inserted into the outer container 4, and an extracted position (shown in FIGS. 3, 6 and 8), in which the inner container 3 is partially extracted from the outer container 4, so as to allow access to the sealed wrap 2.

The outer container 4 has the shape of a parallelepiped with a rectangular cross section, is cup-shaped and has an open upper end, a lower wall 5 opposite the open upper end, a front wall 6 and a rear wall 7, which are parallel to and opposite one another, and two side walls 8, which are parallel to and opposite one another.

Between the walls 6 and 7 and the side walls 8 there are defined four longitudinal corners, whereas between the walls 6, 7 and 8 and the lower wall 5 there are defined four transverse corners.

The cigarette package 1 comprises a lid 9, which is also cup-shaped and is hinged to the outer container 4 along a hinge 10, so as to rotate, relative to the outer container 4, between a closed position (shown in FIGS. 1, 2, 5 and 7) and an open position (shown in FIGS. 3,6 and 8) of the open upper end of the outer container 4. The lid 9 has an upper wall 11 (which, when the lid 9 is in the closed position, is parallel to and opposite the lower wall 5 of the outer container 4), a front wall 12 (which, when the lid 9 is in the closed position, is coplanar to the front wall 6 of the outer container 4), a rear wall 13 (which is connected to the rear wall 7 of the outer container 4 by means of the hinge 10 and, when the lid 9 is in the closed position, is coplanar to the rear wall 7 of the outer container 4), and two side walls 14 parallel to and opposite one another (which, when the lid 9 is the closed position, are coplanar and adjacent to the corresponding side walls 8 of the outer container 4). Between the walls 12 and 13 and the side walls 14 there are defined four longitudinal corners, whereas between the walls 12, 13 and 14 and the upper wall 11 there are defined four transverse corners.

Figure 4:
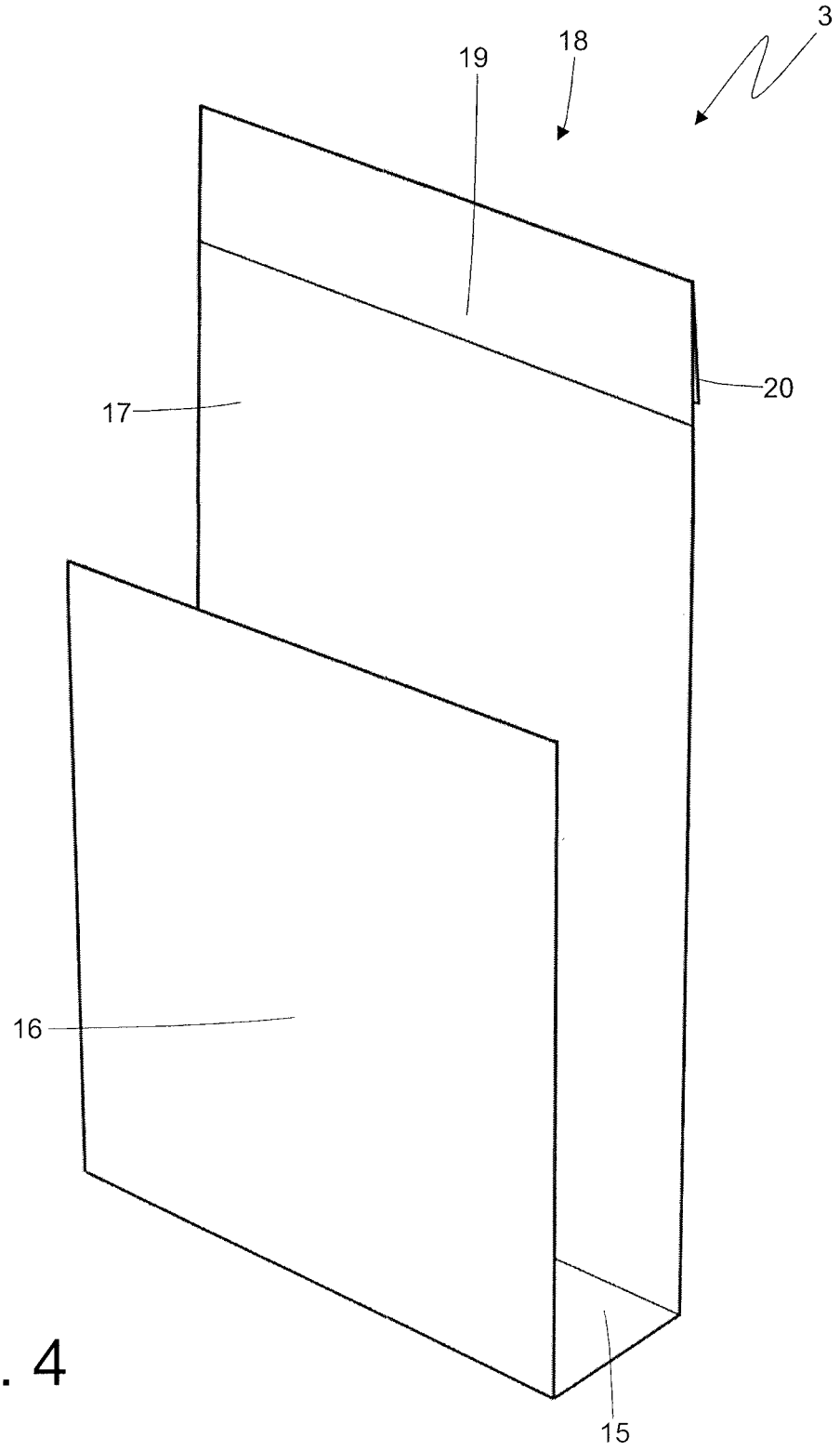
FIG. 4 is a perspective front view of an inner container of the cigarette package of FIG. 1.

According to FIG. 4, the inner container 3 has the shape of a parallelepiped with a rectangular cross section, is cup-shaped and has an open upper end, a lower wall 15, which is opposite the open upper end and parallel to the lower wall 5 of the outer container 4, a front wall 16, which is parallel to the front wall 6 of the outer container 4, and a rear wall 17, which is parallel to the rear wall 7 of the outer container 4. In the embodiment shown in FIG. 4, the inner container has no side walls (namely, it is open on the sides), whereas, according to a variant that is not shown herein, the inner container 3 also has to side walls, which are parallel to the side walls 8 of the outer container 4. Between the walls 16 ad 17 and the possible side walls (where provided) there are defined four longitudinal corners, whereas between the walls 16 and 17 and the lower wall 15 there are defined two transverse corners.

In the following description of the cigarette package 1 we will use, in order to define the positions of portions of the cigarette package 1, terms such as "bottom" and "top" and "front" and "rear" assuming that the package 1 is arranged in such a way that the direction of its main extension coincides with the vertical; therefore, the lower and upper walls are respectively arranged "at the bottom" and "at the top" and the front and rear walls respectively define the "front part" and the "rear part". The main extension direction defines, furthermore, a longitudinal movement direction, which is perpendicular to a transverse movement direction.

As already mentioned above, the inner container 3 slides relative to the outer container 4 with a linear translation movement, parallel to the longitudinal corners, between a lowered position (shown in FIGS. 1, 2, 5 and 7), in which the inner container 3 is completely inserted into the outer container 4 and the lower wall 15 of the inner container 3 rests against (namely, is in contact with) the lower wall 5 of the outer container 4, and an extracted position (shown in FIGS. 3, 6 and 8), in which the inner container 3 is partially extracted from the outer container 4 and the lower wall 15 of the inner container 3 is spaced apart, by a given distance other than zero, from the lower wall 5 of the outer container 4 (said distance corresponding to the lifting of the inner container 3 relative to the outer container 4).

The rear wall 13 of the lid 9 is permanently connected to the rear wall 17 of the inner container 3 by means of a lifting mechanism 18 for the inner container 3 (shown in FIG. 4). The rear wall 13 of the lid 9 is connected to the rear wall 17 of the inner container 3 exclusively by means of the lifting mechanism 18, which means that, except for the lifting mechanism 18, the rear wall 13 of the lid 9 is completely separate from and independent of the rear wall 17 of the inner container 3.

The lifting mechanism 18, which is designed to longitudinally lift the inner container 3, "automatically" controls (i.e. with no need for the user to touch the inner container 3), exploiting the rotation movement of the lid 9, the axial translation (i.e. the sliding movement) of the inner container 3, relative to the outer container 4, between the lowered position and the extracted position, and vice versa; in other words, the lifting mechanism 18 uses the rotation movement of the lid 9 to "automatically" cause (i.e. with no need for the user to touch the inner container 3) the axial translation (i.e. the sliding movement) of the inner container 3, relative to the outer container 4, between the lowered position and the extracted position, and vice versa. As a consequence, thanks to the lifting mechanism 18, which constrains the rear wall 13 of the lid 9 to the rear wall 17 of the inner container 3, when the lid 9 is rotated, relative to the outer container 4, from the closed position to the open position, the inner container 3 is pulled by lid 9 from the lowered position to the extracted position in an "automatic" manner (i.e. with no need for the user to touch the inner container 3); similarly, thanks to the lifting mechanism 18, which constrains the rear wall 13 of the lid 9 to the rear wall 17 of the inner container 3, when the lid 9 is rotated, relative to the outer container 4, from the open position to the closed position, the inner container 3 is pushed by the lid 9 from the extracted position to the lowered position in an "automatic" manner (i.e. with no need for the user to touch the inner container 3). By so doing, the user only needs to apply the thrust needed to cause the rotation of the lid 9 relative to the outer container 4, without having to touch the inner container 3, whose translation is controlled "automatically".

The lifting mechanism 18 comprises a rigid connection tab 19, which, on one side, is directly hinged to the rear wall 17 of the inner container 3 and is integral to the rear wall 13 of the lid 9 (the connection tab 19 typically overlaps and is glued to the rear wall 13 of the lid 9). Furthermore, the lifting mechanism 18 comprises a rigid reinforcement tab 20, which is hinged to the connection tab 19 and overlaps and is glued to the connection tab 19 so as to reinforce (strengthen, stiffen) the connection tab 19. The reinforcement tab 20 is not strictly indispensable, as it plays no role in the operation of the connection tab 19 (which would work in the same way even without the reinforcement tab 20); the reinforcement tab 20 has the only purpose of reinforcing (strengthening, stiffening) the connection tab 19 so as to improve (though not change in its essence) the operation of the connection tab 19).

Figure 9:
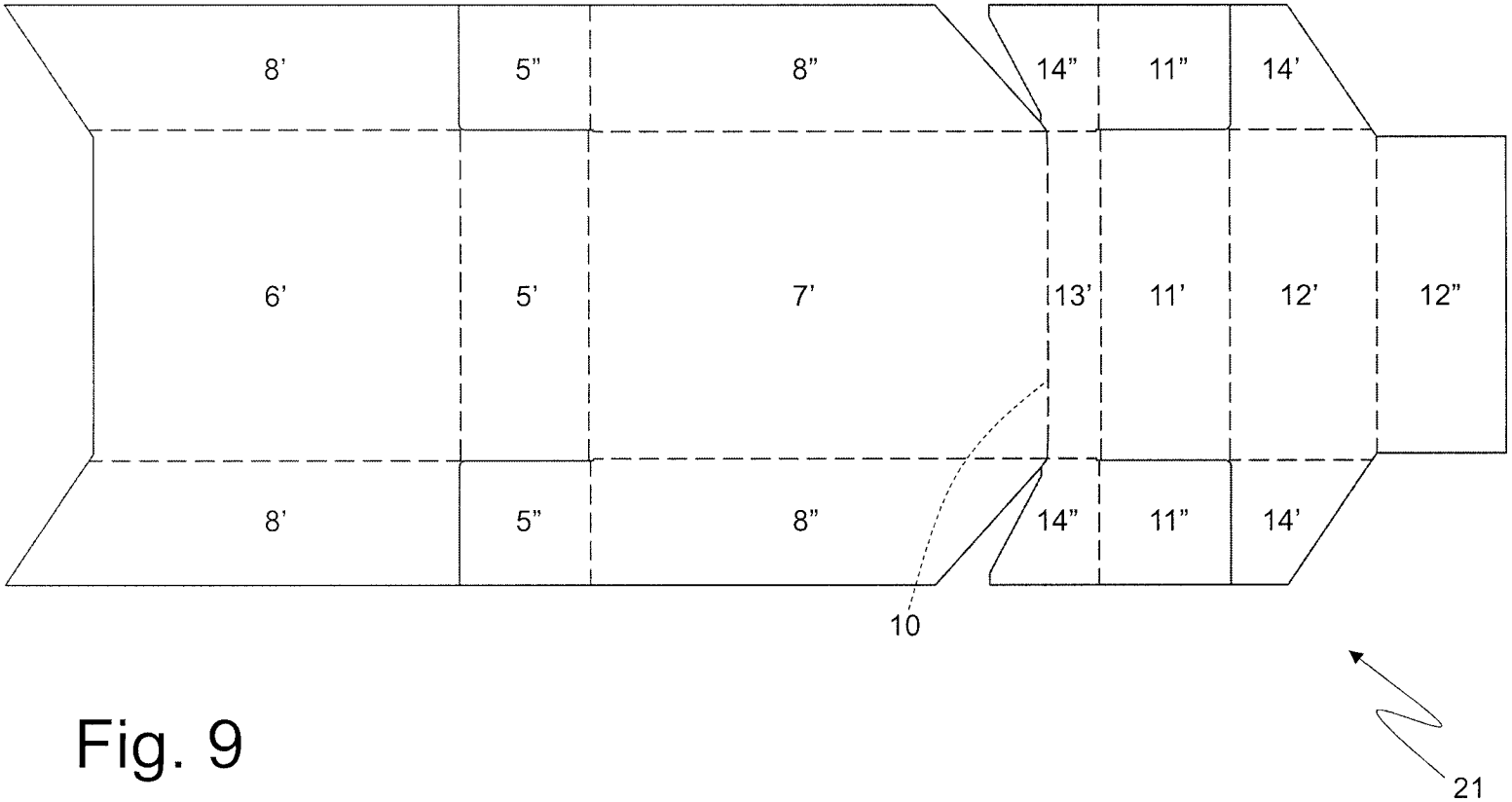
FIG. 9 is a flat representation of a blank used to manufacture an outer container and a lid of the cigarette package of FIG. 1.

According to FIG. 9, the outer container 4 and the lid 9 are obtained starting from a flat blank 21 having a substantially elongated rectangular shape of a known type (namely, of the type commonly used to manufacture a rigid cigarette package with a hinged lid). In FIG. 9, the different parts of the blank 21 were marked, when possible, with accented reference numbers coinciding with the reference numbers indicating the corresponding walls of the outer container 4 and of the lid 9.

Figure 10:
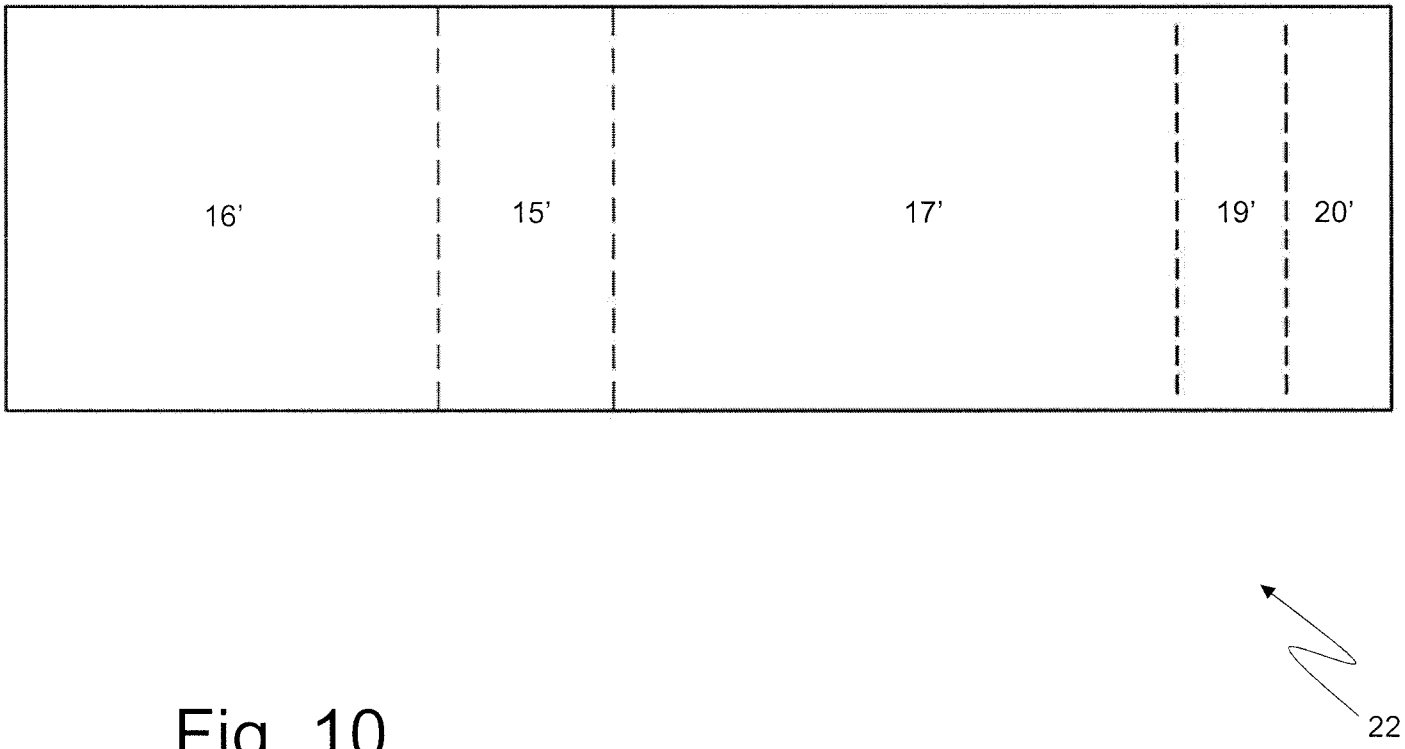
FIG. 10 is a flat representation of a blank used to manufacture the inner container of FIG. 4.

According to FIG. 10, the inner container 3 is obtained starting from a flat blank 22 having a substantially elongated rectangular shape. In FIG. 10, the different parts of the blank 22 were marked, when possible, with accented reference numbers coinciding with the reference numbers indicating the corresponding walls of the inner container 3.

Figure 11:
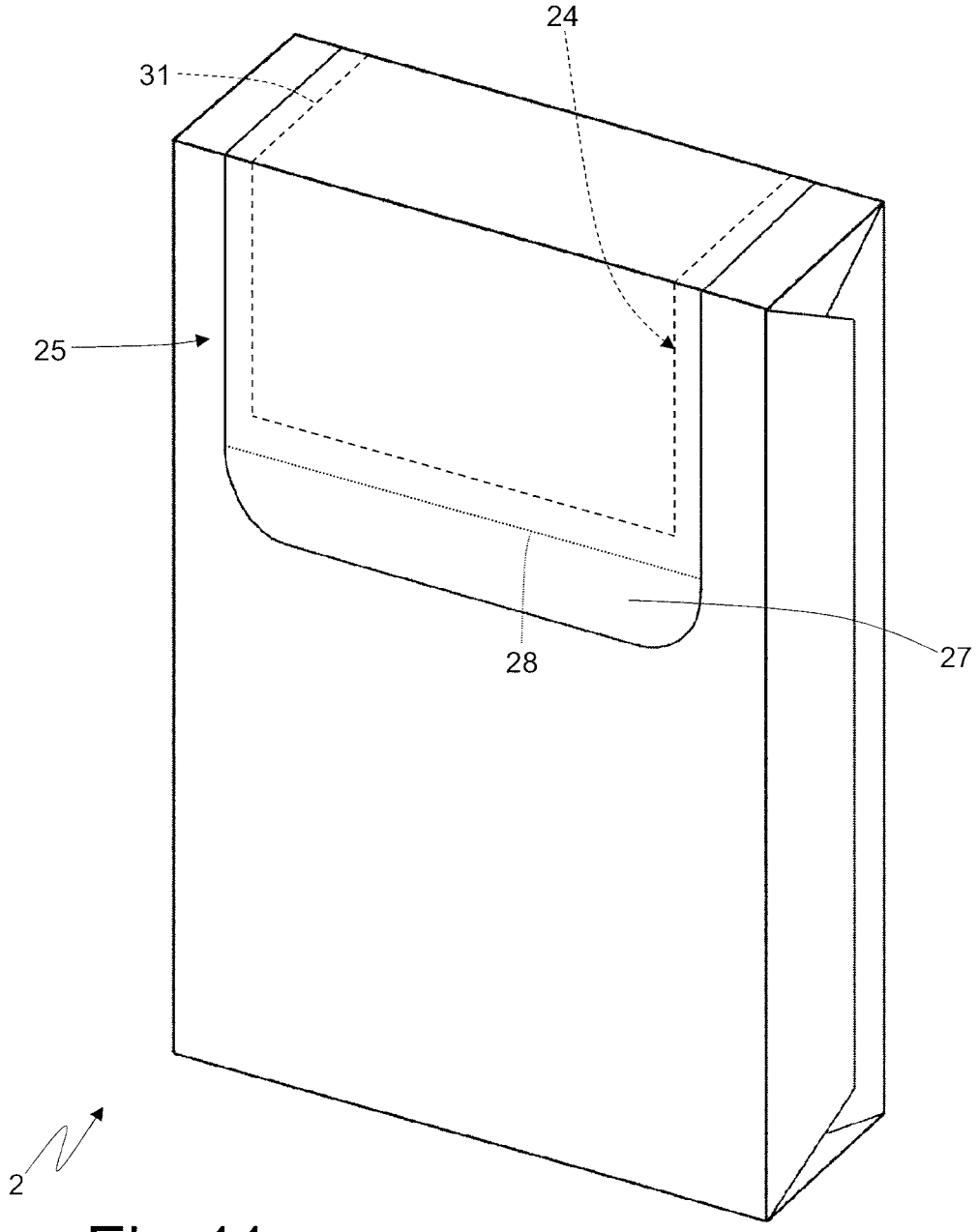
FIG. 11 is a perspective front view of a sealed wrap of the package of FIG. 1 in a closed configuration.
Figure 12:
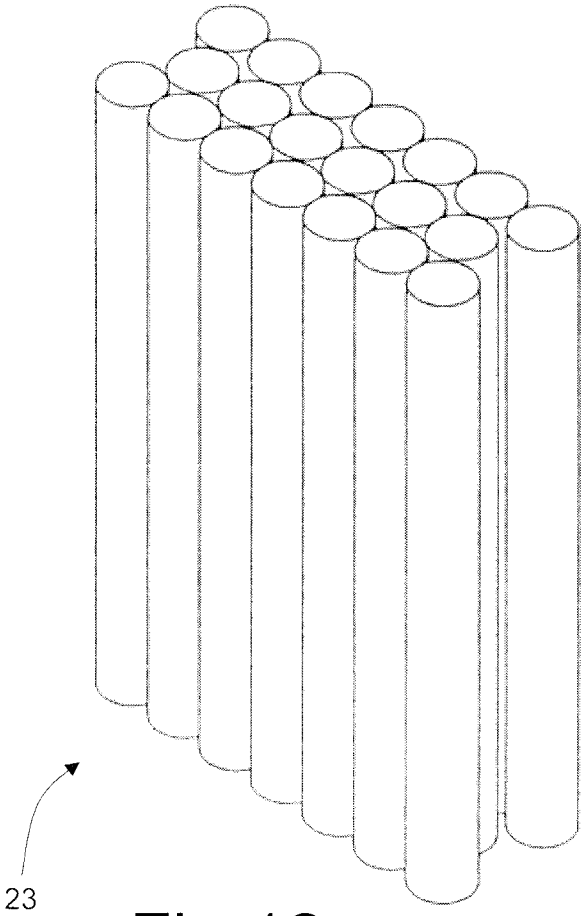
FIG. 12 is perspective view of a group of cigarettes contained in the sealed wrap of FIG. 11.

The wrap 2 encloses a group 23 of cigarettes (shown in FIG. 12) with the shape of a parallelepiped; according to FIG. 11, the wrap 2 has, on the upper side and on the front side, a cigarette extraction opening 24, which is closed by a reusable sealing flap 25.

The sealing flap 25 is fixed to the wrap 2 by means of a non-dry, re-stick glue 26 (shown in FIG. 14), which is applied to the inner surface of the sealing flap 25 (namely, the surface of the sealing flap 25 facing the wrap 2) and is arranged around the extraction opening 24 so as to allow the sealing flap 25 to be partially separated from the wrap 2 many times (i.e. every time the cigarette package 1 is opened) and then fixed again to the wrap 2. The sealing flap 28 is provided with a graspable holding tab 27 (i.e. it can be grasped by a smoker after having opened the lid 9), which is arranged in the lower part of the sealing flap 25; in use, the smoker gets hold of the holding tab 27 between the fingers so as to lower/lift the sealing flap 15, thus opening/closing the extraction opening 24.

According to FIGS. 3 and 5-8, the holding tab 27 of the sealing flap 25 is "U"-folded (namely, it is folded by 180°) around a folding line 28 and against the remaining part of the sealing flap 25, so that, upon opening the lid 9, the inner surface of the holding tab 27 faces outwards; by so doing, when the lid 9 is opened, the holding tab 27 gets detached from the remaining part of the sealing flap 25 due to the elastic return around the folding line 28, thus being easier to be grasped.

Figure 14:
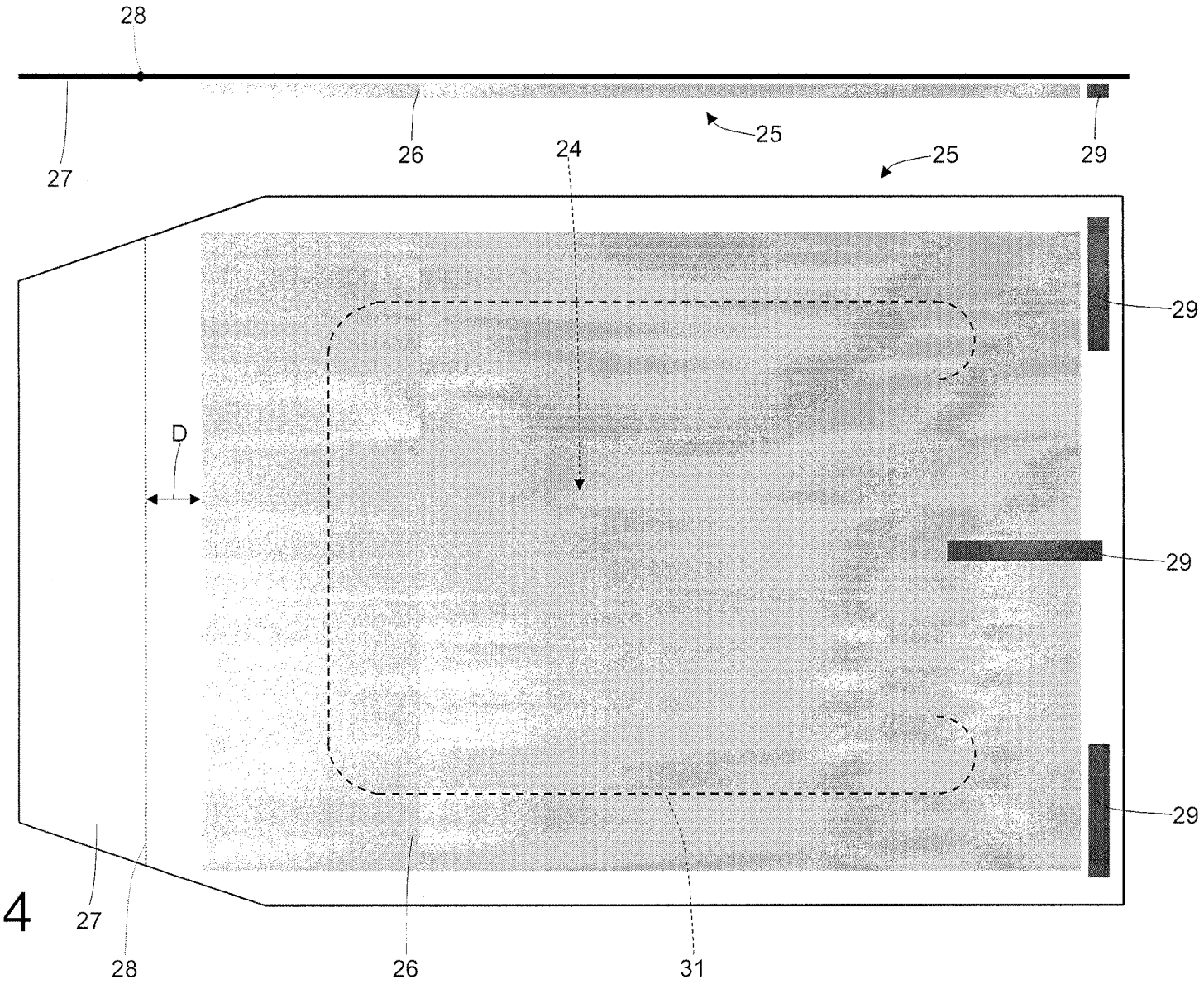
FIG. 14 is a stretched-out view of a sealing flap of the sealed wrap of FIG. 11 with the glue areas available on the sealing flap highlighted.

According to FIG. 14, the holding tab 27 of the sealing flap 25 is completely free from re-stick glue 26. According to a preferred embodiment shown in FIG. 14, the re-stick glue 26 is arranged at a distance D other than zero from the folding line 28, namely the re-stick glue 26 does not touch the folding line 28 and, therefore, there is an intermediate space without re-stick glue 26 close to the folding line 28.

According to a possible embodiment shown in FIG. 14, the sealing flap 25 is connected to the wrap 2 also by means of the permanent glue 29, which is arranged in the area of a rear wall of the wrap 2, namely in a spot where there should never be a separation between the sealing flap 25 and the wrap 2. The presence of the permanent glue 29 ensures a greater and more reliable adhesion between the sealing flap 25 and the wrap 2, thus avoiding any risk of complete (hence undesired) separation of the sealing flap 25 from the wrap 2.

Figure 15:
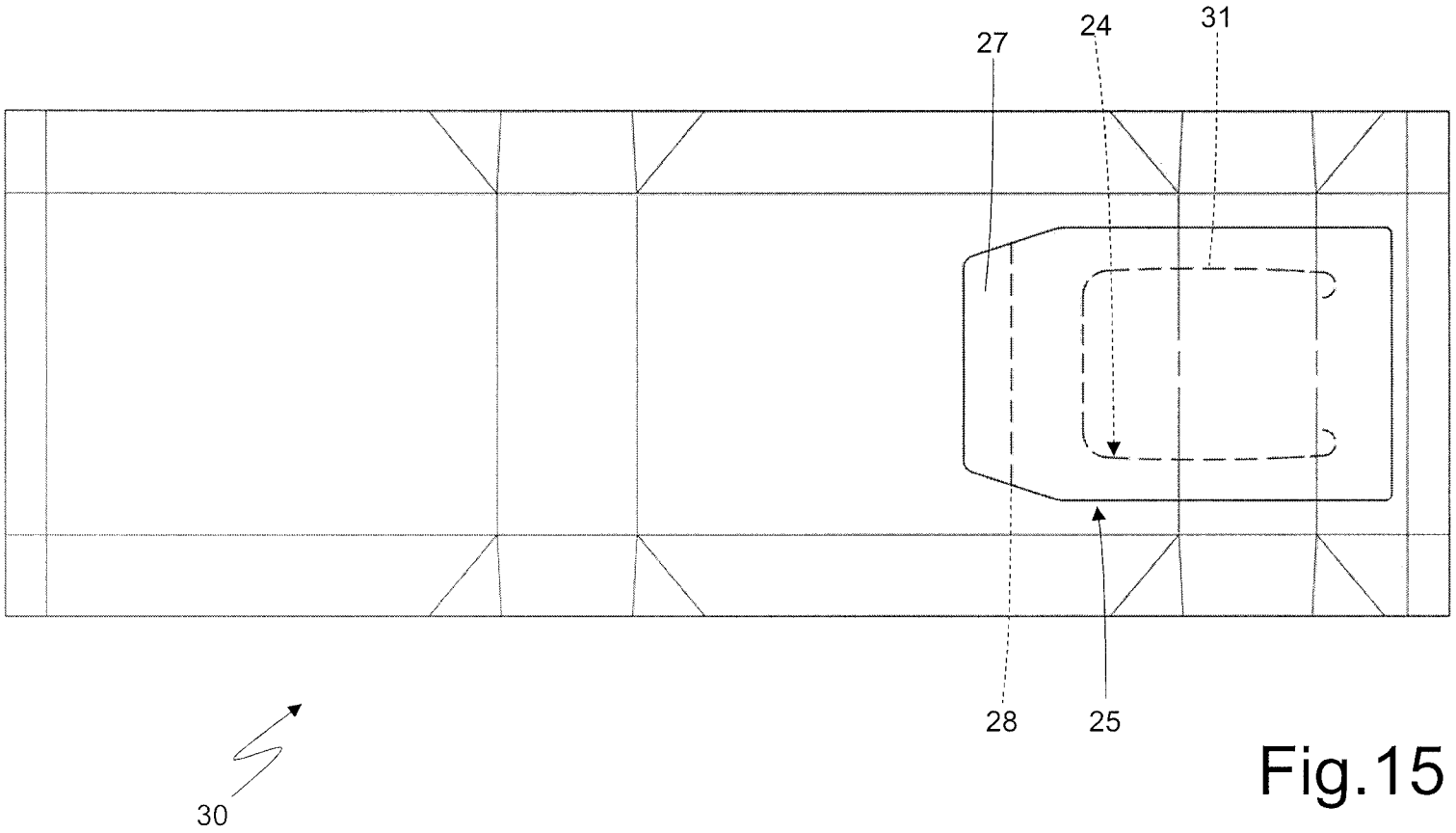
FIG. 15 is a plan view of a heat-sealable wrapper used to manufacture the sealed wrap of FIG. 11.

According to FIG. 15, the wrap 2 is obtained by folding a heat-sealable wrapper 30, which has a rectangular shape, is folded around the group 23 of cigarettes and, after having been folded, is stabilized by means of heat sealing (namely, overlapping portions of the wrapper 30 are connected to one another in a stable manner by means of heat sealing). The wrapper 30 has an incision 31, which is "U"-shaped and defines the extraction opening 24 of the wrap 2; furthermore, the sealing flap 25 is glued to the wrapper 30 so as to completely cover the incision 31 (namely, the extraction opening 24). Between the sealing flap 25 and the wrapper 30 there interposed the re-stick adhesive 17, which is sensitive to pressure (namely, is non-dry) and allows smokers to separate the sealing flap 25 from the wrapper 30 and then join again the sealing flap 25 to the wrapper 30 even after a long time and for a large number of times.

The presence of the re-stick adhesive 17, which is sensitive to pressure (namely, is non-dry), between the sealing flap 25 and the wrapper 30 determines the permanent gluing (which, in use, is never separated) of the portion of the wrapper 30 enclosed inside the incision 31 (namely, in the area of the extraction opening 24) to the sealing flap 25; therefore, when the sealing flap 25 is lifted from the wrapper 30, the portion of the sealing flap 25 enclosed inside the incision 31 (namely, in the area of the extraction opening) is lifted together with the sealing flap 25, thus freeing the extraction opening 24. Furthermore, the presence of the re-stick adhesive 26, which is sensitive to pressure (namely, is non-dry), between the sealing flap 25 and the wrapper 30 determines a temporary gluing (which, in use, is separated) between the portion of the wrapper 30 surrounding the incision 31 (i.e. surrounding the extraction opening 24) and the sealing flap 25, so as to normally hold the sealing flap 25 in contact with the wrapper 30 to close (seal) the extraction opening 24.

Figure 13:
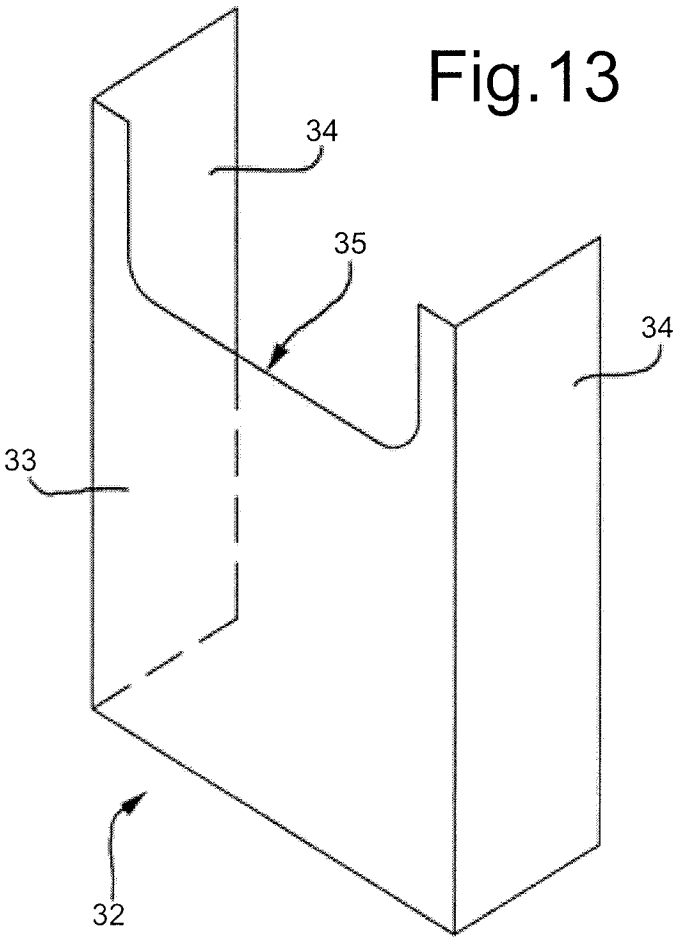
FIG. 13 is a perspective view of a reinforcement element of the sealed wrap of FIG. 11.

According to FIG. 13, the wrap 2 comprises a reinforcement element 32, which is made of cardboard or rigid paperboard (completely similar to the cardboard or rigid paperboard making up the outer container 4), is "U"-shaped and is arranged inside the wrap 2 in contact with the group 23 of cigarettes. The reinforcement element 32 comprises a front wall 33 with a rectangular shape, which is arranged, on one side, in contact with a front wall of the group 23 of cigarettes and, on the opposite side, in contact with the front wall of the wrap 2, and a pair of side walls 34, which are connected to the opposite sides of the front wall 33 and are arranged, on one side, in contact with the side walls of the group 23 of cigarettes and, on the opposite side, in contact with the side walls of the wrap 2. The front wall 33 of the reinforcement element 32 has a recess 35, which is arranged on the upper side, is "U"-shaped and enables the extraction of the cigarettes of the group 23 of cigarettes, as it exposes an upper area of the front wall of the group 23 of cigarettes in the area of the extraction opening.

Figure 5:
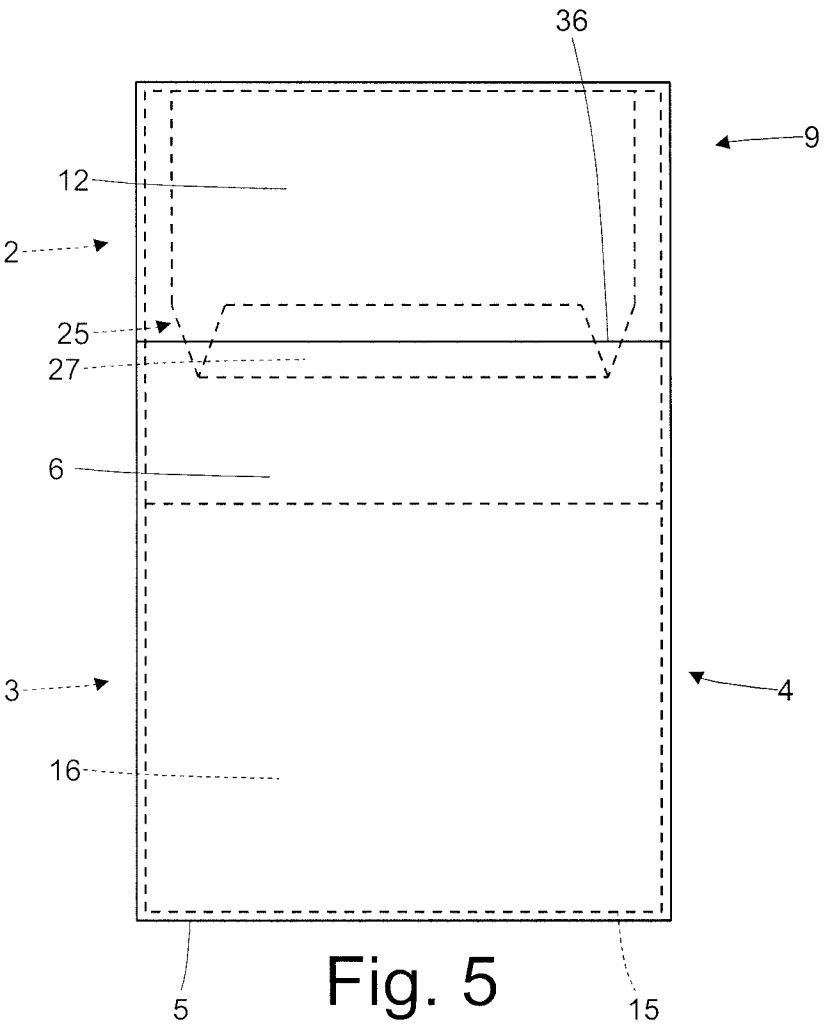
Figure 7:
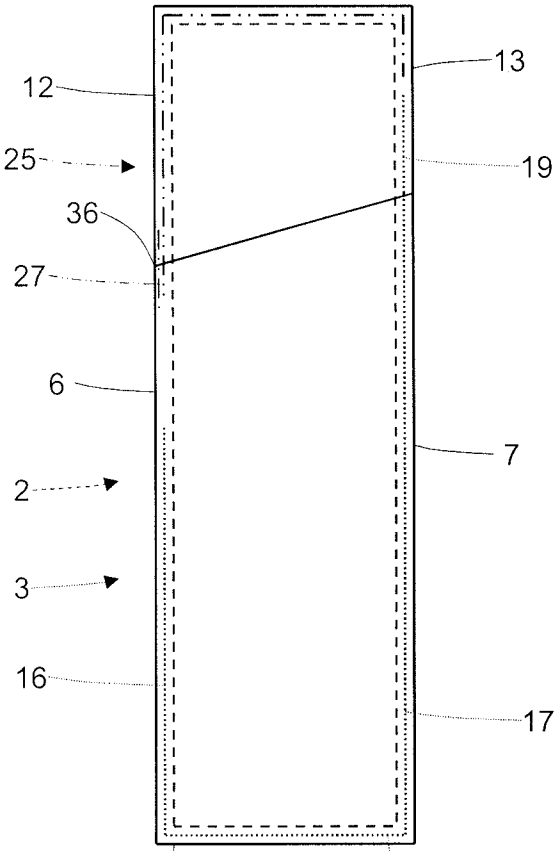

According to FIGS. 5 and 7, when the lid 9 is in the closed position, the inner container 3 is arranged in the lowered position and the holding tab 27 of the sealing flap 25 of the wrap 2 (housed in the inner container 3) is at least partially arranged inside the outer container 4, namely lower than an upper edge 36 of the front wall 6 of the outer container 4; in other words, when the lid 9 is in the closed position (shown in FIGS. 5 and 7), the inner container 3 is arranged in the lowered position and the holding tab 27 of the sealing flap 25 of the wrap 2 is at least partially covered by the front wall 6 of the outer container 4.

Figure 6:
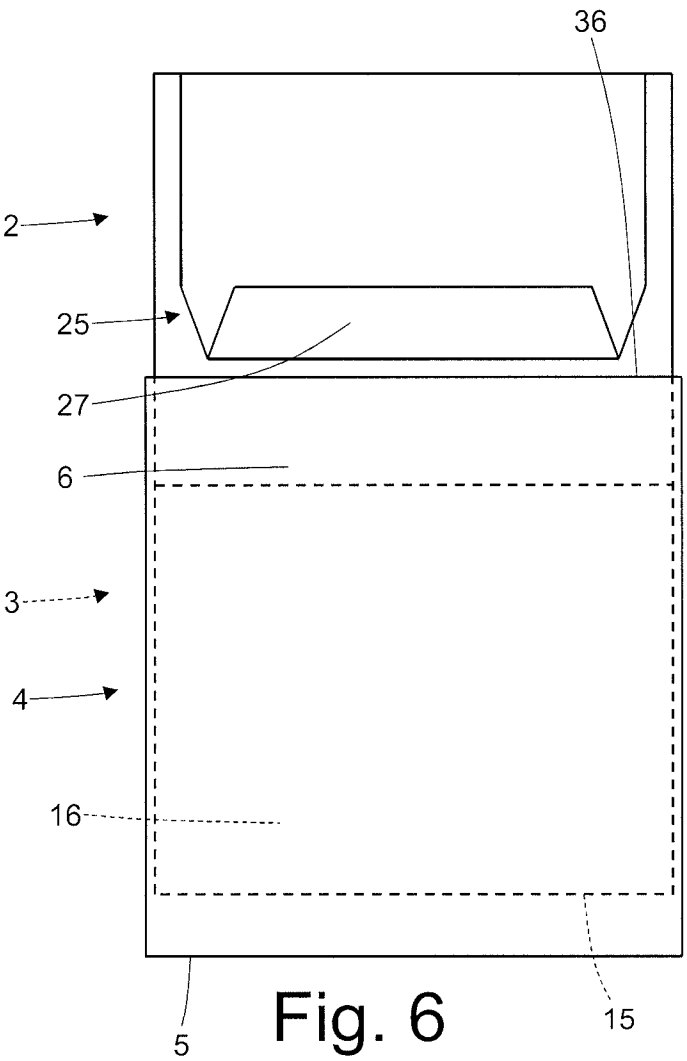
FIGS. 5 and 6 are two schematic front views of the cigarette package of FIG. 1 in a closed configuration and in an open configuration, respectively.
Figure 8:
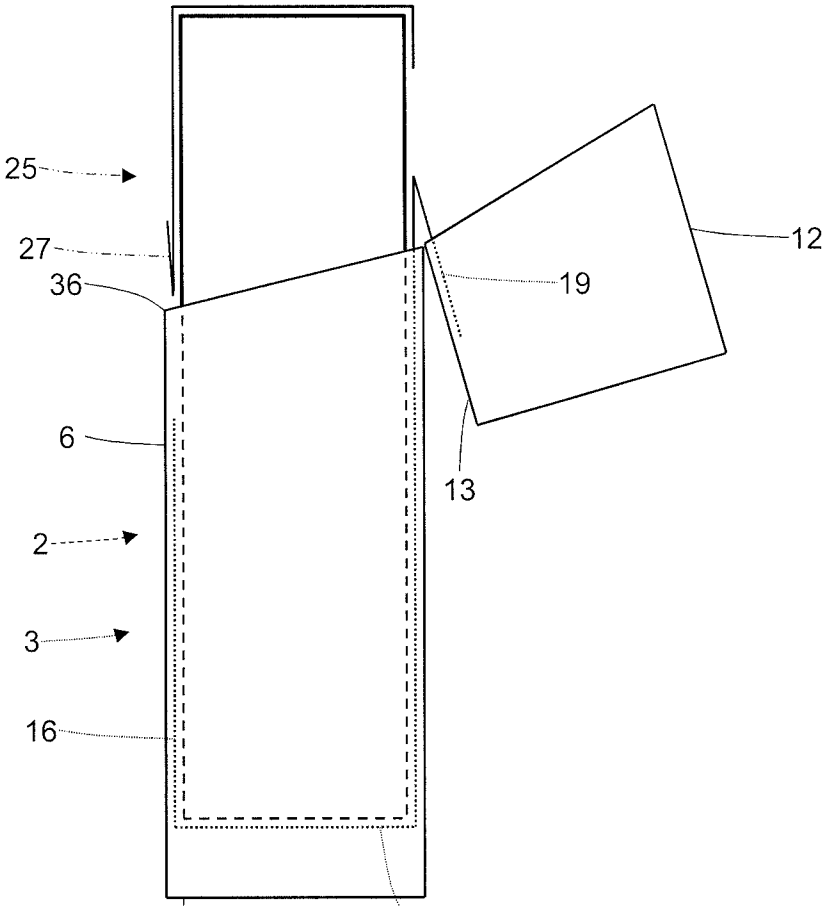
FIGS. 7 and 8 are two schematic side views of the cigarette package of FIG. 1 in a closed configuration and in an open configuration, respectively.

According to FIGS. 6 and 8, when the lid 9 is in the open position, the inner container 3 is arranged in the extracted position and the holding tab 27 of the sealing flap 25 of the wrap 2 (housed in the inner container 3) is completely arranged outside the outer container 4, namely higher than the upper edge 36 of the front wall 6 of the outer container 4; in other words, when the lid 9 is in the open position (shown in FIGS. 6 and 8), the inner container 3 is arranged in the extracted position and the holding tab 27 of the sealing flap 25 of the wrap 2 is completely free from the front wall 6 of the outer container 4.

By opening/closing the lid 9, namely by longitudinally lifting/lowering the inner container 3 relative to the outer container 4, the holding tab 27 of the sealing flap 25 of the wrap 2 comes out of/re-enters into the upper edge 36 of the front wall 6 of the outer container 4.

To this regard, as you can see in FIGS. 7 and 8, the front wall 16 of the inner container 3 keeps the front wall 6 of the outer container 4 slightly separated from the front wall of the wrap 2, thus creating an empty space, which houses the holding tab 27 of the sealing flap 25 of the wrap 2; as a consequence, the holding tab 27 of the sealing flap 25 of the wrap 2 easily comes out of/re-enters into the upper edge 36 of the front wall 6 of the outer container 4, as the front wall 6 of the outer container 4 is slightly detached from the front wall of the wrap 2 due to the presence of the front wall 16 of the inner container 3. Obviously, the front wall 16 of the inner container 3 is always arranged lower than the holding tab 27 of the sealing flap 25 of the wrap 2, so as to never overlap the holding tab 27.

According to a different embodiment, which is not shown herein, the holding tab 27 of the sealing flap 25 of the wrap 2 is not folded by 180° around the folding line 28 and against the remaining part of the sealing flap 25, but it is coplanar to the sealing flap 25 (as you can see in FIGS. 11, 14 and 15, wherein the holding tab 27 has not yet been folded by 180° against the remaining part of the sealing flap 25). In this embodiment, again, the holding tab 27 of the sealing flap 25 of the wrap 2 comes out of/re-enters into the upper edge 36 of the front wall 6 of the outer container 4 by opening/closing the lid 9, namely by longitudinally lifting/lowering the inner container 3 relative to the outer container 4.

According to a different embodiment, which is not shown herein, the holding tab 27 of the sealing flap 25 of the wrap 2 is always arranged higher than the upper edge 36 of the front wall 6 of the outer container 4 and, therefore, the translation of the inner container 3 relative to the outer container 4 does not cause the holding tab 27 of the sealing flap 25 of the wrap 2 to come out of/re-enter into the upper edge 36 of the front wall 6 of the outer container 4.

According to a further embodiment, which is not shown herein, the holding tab 27 (folded or not folded by 180° around the folding line 28) is glued—in a permanent and non-separable manner—to the inner surface of the front wall 12 of the lid 9 by means of permanent glue; by so doing, the sealing flap 25 is simultaneously opened and closed when opening or closing the lid 9. This embodiment uses the disclosure of patent applications WO2008142540A1 and WO2012147073A1, to which reference is made for further building details. Obviously, in this embodiment, the holding tab 27 of the sealing flap 25 of the wrap 2 is always arranged higher than the upper edge 36 of the front wall 6 of the outer container 4 and, therefore, the translation of the inner container 3 relative to the outer container 4 does not cause the holding tab 27 of the sealing flap 25 of the wrap 2 to come out of/re-enter into the upper edge 36 of the front wall 6 of the outer container 4. In particular, this embodiment (in which the holding tab 27 is glued—in a permanent and non-separable manner—to the inner surface of the front wall 12 of the lid 9) comprises the inner container 3, which hence lifts/lowers the wrap 2 following the opening/closing of the lid 9.

Figure 16:
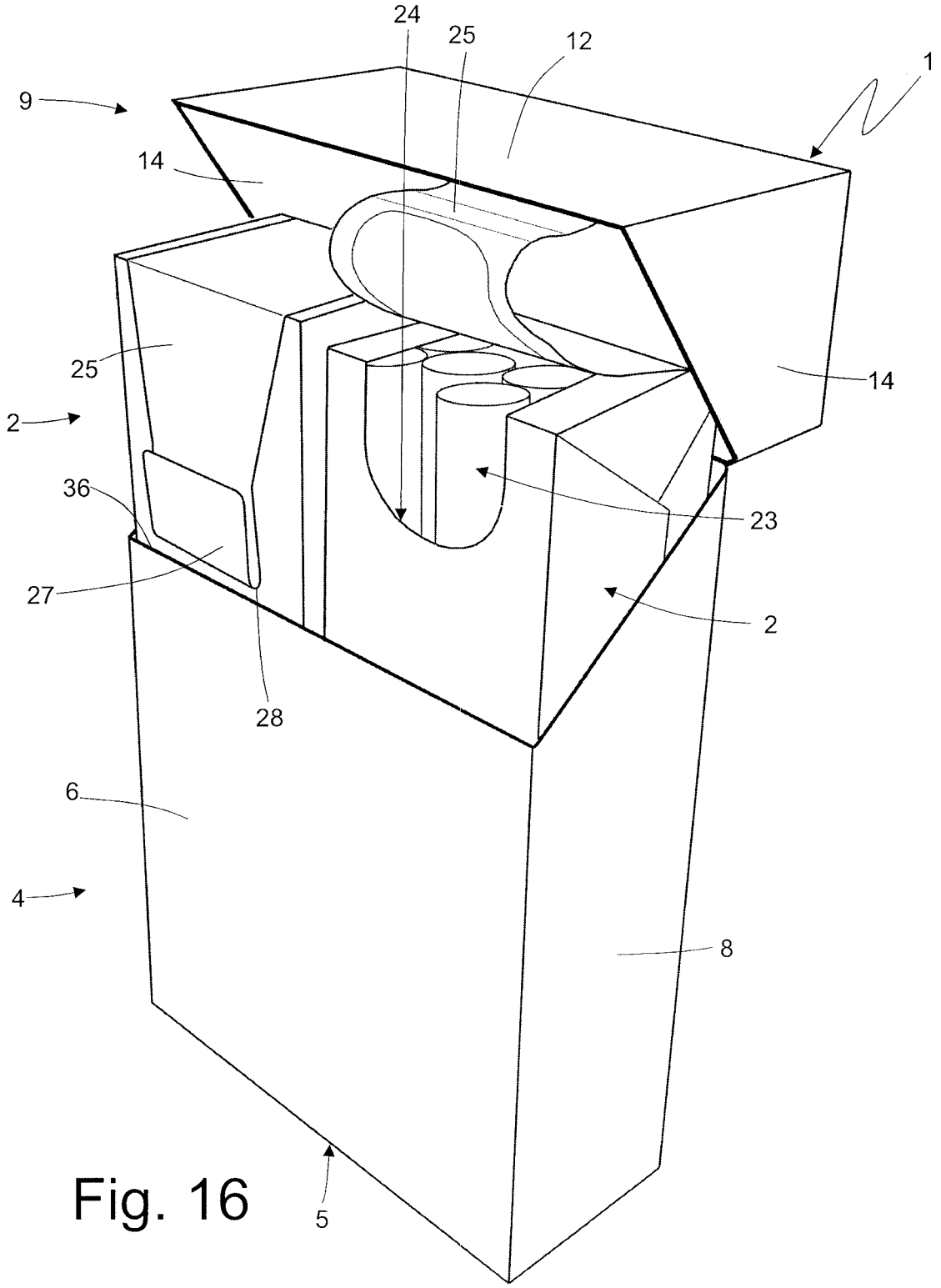
FIG. 16 is a perspective front view of a different embodiment of the cigarette package of FIG. 1 in an open configuration.

In the variant shown in FIG. 16, the cigarette package 1 comprises two wraps 2 arranged beside one another, each enclosing a corresponding group 23 of cigarettes; preferably, each group 23 of cigarettes, in the embodiment shown in FIG. 16, is equal to half the group 23 of cigarettes in the embodiment shown in FIGS. 1-5. In the embodiment shown in FIG. 16, the two wraps 2 have different configurations: the left wrap 2 is completely similar to the wrap 2 shown in FIGS. 1-15 and, therefore, has the holding tab 27 of the sealing flap 25 folded in a "U" shape, longitudinally translates relative to the outer container 4 due to the action of a corresponding inner container 3, and the holding tab 27 of the sealing flap 25 of the wrap 2 comes out of/re-enters into the upper edge 36 of the front wall 6 of the outer container 4 by opening/closing the lid 9; on the other hand, in the right wrap 2, the holding tab 27 is glued—in a permanent and non-separable manner—to the inner surface of the front wall 12 of the lid 9. In the embodiment shown in FIG. 16, the right wrap 2 is not provided with an inner container 3 and, therefore, does not translate relative to the outer container 4 by rotating the lid 9; alternatively, the right wrap 2 could be coupled to its own inner container 3 as well and, therefore, could translate relative to the outer container 4 by rotating the lid 9 (in this case, there could be one single common inner container 3, which houses both wraps 2).

In the embodiments shown in the accompanying drawings, the inner container 3 has a cross section that substantially has the same size as the cross section of the outer container 4 (except for a minimum clearance that, at the first approximation, is negligible and permits the sliding movement thereof); therefore, the inner container 3 entirely occupies the inner volume of the outer container 4 (without remarkable free spaces). According to a different and perfectly equivalent embodiment, which is not shown herein, the inner container 3 has a cross section that is smaller than the cross section of the outer container 4 and, as a consequence, the inner volume of the outer container 4 is not completely occupied by the inner container 3 and a significant portion of the inner volume (ranging from 20 to 50% of the inner volume) is free from (namely, is not occupied by) the inner container 3. For example, the rear wall 17 of the inner container 3 could be spaced apart from the rear wall 7 of the outer container 4 (by at least 2.5-3 mm) so as to define, inside the outer container 4, a chamber, which is arranged beside the inner container 3 and houses the lifting mechanism 18 (preferably shaped differently from what is shown in the accompanying drawing, for example according to the disclosure of Italian patent application BO2014A000576); said chamber is not occupied by the inner container 3 and is designed to exclusively house the lifting mechanism 18, which permits the lifting or lowering of the wrap 2 enclosing the group 23 of cigarettes, when the lid 9 is respectively opened or closed.

In the embodiments shown in the accompanying drawings, the lifting mechanism 18 only has one connection tab 19, which is integral to the rear wall 13 of the lid 9; according to alternative and perfectly equivalent embodiments, which are not shown herein, the lifting mechanism 18 has a greater number of connection tabs 20, which could be integral to the upper wall 11 and/or to the front wall 12 of the lid 9. According to a further embodiment, which is not shown herein, the connection tab 19 is flexible (instead of being rigid) and, therefore, is completely free to deform without constraints (and, of course, it is not provided with the reinforcement tab 20); for example, the connection tab 19 could have a given (large) number of weakening lines, transverse and close to one another, which allow the connection tab 19 to be highly flexible.

The cigarette package 1 described above has numerous advantages.

First of all, the cigarette package 1 described above allows manufacturers to increase, given the same size features (in particular, given the same size of the extraction opening 24), the size of the holding tab 27, as lifting the wrap 2 (namely, the inner container 3 carrying the wrap 2) relative to the outer container 4 when the lid 9 is opened allows you to expose a larger surface of the front wall of the wrap 2 and, therefore, allows you to have a larger holding tab 27 with the same size of the extraction opening 24 (or to have a greater extraction opening 24 with the same size of the holding tab 27).

Furthermore, when the holding tab 27 of the sealing flap 25 of the wrap 2 comes out of/re-enters into the upper edge 36 of the front wall 6 of the outer container 4 by opening/closing the lid 9, the closing of the lid 9 is very simple, as the user only has to move the lid 9 without having to worry about the holding tab 27, because the holding tab 27 autonomously slips under the upper end 36 of the front wall 6 of the outer container 4 due to the slight distance between the front wall 16 of the inner container 3 and the front wall 6 of the outer container 4.

Finally, the cigarette package 1 described above is easy to be manufactured, even in an existing manufacturing machine (which needs to be subjected to a few non-invasive changes). As a matter of fact, the wrap 2, the outer container 4 and the lid 9 (hence, the corresponding wrapper 30 and blank 21) are completely identical to the wrap, the outer container and the lid (hence, the corresponding wrapper and blank) of a rigid cigarette package with a hinged lid and with a sealed wrap of the known type, and the inner container 3 can be manufactured by folding the blank 21 around the wrap 2 in the unit that is usually used to insert a coupon, provided that some simple changes are made to the unit.

The invention claimed is:

1. A rigid package (1) for tobacco articles with a hinged lid (9) and comprising:

at least one group (23) of tobacco articles;

at least one wrap (2), which encloses the group (23) of tobacco articles an outer container (4), which has a front wall (6) and a rear wall (7);

a lid (9) having a rear wall (13), which is hinged to the rear wall (7) of the outer container (4) so as to allow the lid (9) to rotate relative to the outer container (4);

an inner container (3), which has a rear wall (17), houses the wrap (2) and is arranged inside the outer container (4) in a sliding manner; and a lifting mechanism (18), which connects the inner container (3) to the lid (9) so as to move the inner container (3) relative to the outer container (4), using the rotation movement of the lid (9), between a lowered position, in which the inner container (3) is completely inserted into the outer container (4), and an extracted position, in which the inner container (3) is partially extracted from the outer container (4);

the package (1) is characterized in that:

the wrap (2) has a tobacco article extraction opening (24) closed by a re-stick sealing flap (25); and the lifting mechanism (18) comprises a rigid connection tab (19), which, on one side, is directly hinged to the rear wall (17) of the inner container (3) and is glued to the rear wall (13) of the lid (9).

2. A rigid package (1) for tobacco articles according to claim 1, wherein the sealing flap (25) is provided with a graspable holding tab (27), which is arranged in the bottom part of the sealing flap (25).

3. A package (1) for tobacco articles according to claim 2, wherein the holding tab (27) of the sealing flap (25) is "U"-folded against the remaining part of the sealing flap (25).

4. A package (1) for tobacco articles according to claim 2, wherein the holding tab (27) is always arranged higher than an upper edge (36) of the front wall (6) of the outer container (4).

5. A package (1) for tobacco articles according to claim 2, wherein, by opening/closing the lid (9), namely by longitudinally lifting/lowering the inner container (3) relative to the outer container (4), the holding tab (27) of the sealing flap (25) comes out of/re-enters into an upper edge (36) of the front wall (6) of the outer container (4).

6. A package (1) for tobacco articles according to claim 5, wherein:

when the lid (9) is in the closed position, the inner container (3) is arranged in the lowered position and the holding tab (27) of the sealing flap (25) is at least partially arranged inside the outer container (4) and, therefore, it is at least partially covered by the front wall (6) of the outer container (4); and when the lid (9) is in the open position, the inner container (3) is arranged in the extracted position and the holding tab (27) of the sealing flap (25) is completely arranged outside the outer container (4) and, therefore, it is completely free from the front wall (6) of the outer container (4).

7. A package (1) for tobacco articles according to claim 1, wherein the sealing flap (25) is provided with a holding tab (27), which is arranged in the bottom part of the sealing flap (25) and is glued—in a permanent and non-separable manner—to the inner surface of a front wall (12) of the lid (9) by means of permanent glue.

8. A package (1) for tobacco articles according to claim 1, wherein the inner container (3) comprises a front wall (16), which is arranged in contact with the front wall (6) of the outer container (4) and is always arranged lower than the holding tab (27) of the sealing flap (25), so as to never overlap the holding tab (27).

9. A package (1) for tobacco articles according to claim 1, wherein the lifting mechanism (18) comprises a rigid reinforcement tab (20), which is hinged to the connection tab (19) and overlaps and is glued to the connection tab (19).

10. A package (1) for tobacco articles according to claim 1, wherein:

the wrap (2) consists of a folded wrapper (30) having an incision (31), which defines the extraction opening (24) and is completely covered by the sealing flap (25);

between the sealing flap (25) and the wrapper (30) there in interposed a re-stick adhesive.

* * * * *